US006684599B1

(12) United States Patent
Fresnel

(10) Patent No.: US 6,684,599 B1
(45) Date of Patent: Feb. 3, 2004

(54) APPARATUS FOR PUTTING SLEEVES ONTO CONVEYED ARTICLES

(75) Inventor: Eric Fresnel, Paris (FR)

(73) Assignee: Sleever International Company, Morangis (FR)

( * ) Notice: Subject to any disclaimer, the term of this patent is extended or adjusted under 35 U.S.C. 154(b) by 0 days.

(21) Appl. No.: 09/700,786

(22) PCT Filed: May 12, 1999

(86) PCT No.: PCT/FR99/01135

§ 371 (c)(1),
(2), (4) Date: Nov. 20, 2000

(87) PCT Pub. No.: WO99/59871

PCT Pub. Date: Nov. 25, 1999

(30) Foreign Application Priority Data

May 20, 1998 (FR) ..... 98 06399

(51) Int. Cl.[7] ..... B65B 57/02

(52) U.S. Cl. ..... 53/64; 53/68; 53/585; 53/65

(58) Field of Search ..... 53/64, 65, 68, 53/71, 296, 291, 585

(56) References Cited

U.S. PATENT DOCUMENTS 4,217,744 A * 8/1980 Mizutani ..... 53/71
4,525,977 A * 7/1985 Matt
4,565,592 A 1/1986 Wehrmann et al.
4,600,371 A * 7/1986 Fresnel
4,726,168 A * 2/1988 Seko ..... 53/64
4,765,121 A * 8/1988 Konstantin et al. ..... 53/585
4,910,941 A * 3/1990 Nagano et al. ..... 53/291
4,922,683 A 5/1990 Connolly
5,315,807 A * 5/1994 Restle et al.
6,272,815 B1 * 8/2001 Todd et al.

FOREIGN PATENT DOCUMENTS

EP A1 03 66 267 5/1990

OTHER PUBLICATIONS

International Search Report (PCT/ISA/210).

* cited by examiner

*Primary Examiner*—Eugene Kim
*Assistant Examiner*—Sameh H. Tawfik
(74) *Attorney, Agent, or Firm*—Nixon Peabody LLP; Stuart J. Friedman

(57) ABSTRACT

The invention relates to apparatus for placing sleeves on conveyed articles, said sleeves being cut-off from a continuous sheath (13) passing over a floating type sheath-opening shaper (20). According to the invention, the wheels (30, 31) for lowering the sheath and the wheels (32, 33) for ejecting the cut-off sheath segment (15) are rotated by associated electric motors (41; 42, 43) controlled synchronously by a common electronic programmer (50) arranged to determine a continuous profile of speed variation so as to control the lowering of each sheath segment, said programmer including at least one control card (55) which co-operates with an adjacent encoder (47) mounted at the end of a shaft (46) rotated by a central motor and gearbox unit (40, 45). The synchronization obtained makes it possible to envisage very high rates of throughput while using sleeves of a diameter that is hardly greater than the maximum diameter of the articles.

8 Claims, 1 Drawing Sheet

13
17
18
22
P
20
42,43
41
44
50
21
26
31
41
55
45
40
30
25
51
47
14
25
26
27
θ
46
36
24
52
16
34
63
54
62
70
23
28
35
61
43
32
33
42
44
15
10
10
10
11
60
100
12
65
64

U
P2 (42,43)
P1 (41)
θ

APPARATUS FOR PUTTING SLEEVES ONTO CONVEYED ARTICLES

FIELD OF THE INVENTION

The present invention relates to putting sleeves, in particular heat-shrink sleeves, onto articles that are being conveyed, the articles carrying their sleeves subsequently passing through a shrinking oven.

BACKGROUND OF THE INVENTION

To put heat-shrink sleeves on articles being conveyed, it is conventional to use a technique whereby the sleeves are cut to length from a continuous sheath passing over a shaper for opening the sheath, which shaper is held in a floating position by co-operation between outside wheels and parallel-axis backing wheels carried by the shaper, which outside wheels serve to cause the sheath to advance over the shaper in a generally vertical direction towards cutting means.

For the technological background, reference can be made, for example, to the following documents: EP-A-0 368 663, EP-A-0 366 267, EP-A-0 048 656, U.S. Pat. No. 4,565,592, and JP-A-57 36612.

In some circumstances, the above general approach has been associated with second wheels provided downstream from the cutting means to eject the cut-off segment of sheath onto the article which is brought into register with the shaper by conveyor means for moving the articles stepwise. There are then first outside wheels for causing the sheath to advance over the shaper, and second outside wheels serving to eject the cut-off segment of sheath onto the article in question. All of the outside wheels are naturally motor driven and various types of arrangement have been used to motorize them.

In a first type of arrangement, proposals have been made for the motorization of the second wheels to be completely independent from that of the first wheels so as to allow the second wheels to rotate much faster than the first, thereby causing the cut-off segment of sheath to fall vertically and quickly onto the article in question. That approach is illustrated by document EP-A-0 109 105.

In that document, an article sensor cell is used to respond to an article coming vertically below the vertical shaper by triggering operation of the motors that drive the first wheels and by triggering separate operation of the motors that drive the second wheels so as to cause the sheath to advance over the shaper, so as to cause the sheath to be cut, and so as to cause the cut-off segment to be ejected onto the article. In theory, that approach enables the rate of throughput of the apparatus to be increased, however throughput remains limited because the cut-off segment of sheath is purely and simply ejected onto the article without its downward movement being controlled in any way, and because the articles are delivered, e.g. by means of a worm screw, in independent manner without any synchronization with triggering the descent of the cut-off segment. Furthermore, with certain complicated shapes of article, it is necessary with such apparatus to provide a sleeve of diameter that is much greater than the maximum diameter of the article, thereby considerably restricting control over the quality of sleeve shrinking. When high rates of throughout are reached, it is found that some of the sleeves are incorrectly positioned on the articles, particularly when the sleeves are of considerable height, and even that some articles reach the downstream end of the conveyor apparatus without being provided with a sleeve at all.

In a second approach, still using the same principle of first outside wheels moving the sheath downwards and second outside wheels located downstream from the cutting device and ejecting a cut-off segment of sheath onto an article, rotary drive of the first and second wheels is synchronized. This is well illustrated by document EP-A-0 000 851.

In that document, the ejector wheels disposed downstream from the cutting means are mechanically linked to the first ejector wheels for lowering the sheath, with these wheels being rotated by a single electric motor. Under such circumstances, the various movements are necessarily properly synchronized, but there are limits on possible rates of throughput that are inherent to the fact that the same motor serves to lower the sheath, to cut the sheath, and to drop the cut-off segment of sheath. If the travel speed of the articles is increased, and particularly if it is desired to use sleeves of diameter that is hardly any greater than the maximum diameter of the article, it becomes difficult to conserve the accuracy with which the segments of sheath move down onto the articles, and indeed the articles can also suffer from problems of stability at high rates of throughput. Another drawback of that apparatus lies in the imposed constant speed which is inherent to using a single motor, and which can never vary if the rate of throughput of the machine is modified. It is therefore not possible either to vary the normal operating speed, or to take account of the upstream charge of conveyed articles. In addition, it should be observed that the profile of speed variation for an electric motor as used in document EP-A-0 000 851, and also as used in the above-described document EP-A-0 109 105, is always in the form of a squarewave, with a steep rising slope when the wheels are started, a horizontal plateau for the constant operating speed, and a steep falling slope for stopping the wheels and bringing them to rest. Such a squarewave type of profile with two sudden changes when getting up to constant speed and when stopping inevitably gives rise to shaking which disturbs the proper operation of the process of putting the sleeves into place once high rates of throughput have been reached. Such shaking makes it impossible to use sleeves having one or more lines of microperforations making them easier to open. This problem becomes even worse when it is desired to obtain cut-off segments of considerable height, since more power is then required of the drive motor, thereby further increasing the amount of shaking.

SUMMARY OF THE INVENTION

An object of the invention is to improve a machine of the type described in document EP-A-0 000 851, by conserving the principle of synchronizing sheath advance over the shaper and ejection of the cut-off segment of sheath onto the article in question, using control means and motorization means in such a manner as to avoid encountering the above-described drawbacks both concerning the accuracy with which cut-off segments of sheath are transferred onto the articles, and concerning the constraints that arise at the speed used, thereby naturally opening the way to extremely high rates of throughput, even when using sleeves that are very long.

According to the invention, this problem is resolved by apparatus for placing sleeves onto conveyed articles, said sleeves being cut from a continuous sheath passing over a sheath opening shaper which is held floating by co-operation between first outside wheels and parallel-axis backing wheels carried by said shaper, said first wheels causing the sheath to advance along the shaper up to cutting means, second outside wheels being provided downstream from the cutting means to eject the cut-off sheath segment onto the article fed into register with the shaper by stepper conveyor means for the articles, said first and second wheels being rotated by associated electric motors controlled synchronously by a common electronic programmer arranged to determine a continuous profile for speed variation of said motors so as to control the transfer of each sheath segment onto the corresponding article, and said programmer including at least one electronic control card which co-operates with an adjacent encoder mounted at the end of a shaft rotated by a central motor and gearbox unit.

Thus, organizing rotary control of the first and second wheels on the basis of a common encoder and at least one electronic card for controlling the shafts, makes it possible to achieve accurate synchronization for the first and second wheels, with very accurate control over the transfer of each segment of sheath onto the corresponding article.

Preferably, the continuous profiles for speed variation of the electric drive motors of the first and second wheels are bell-shaped. This bell shape, which can come close to being a sinusoidal profile, is very far removed from the square-wave profile encountered in the above-described prior art machines. The absence of sharp corners in bell-shaped profiles eliminates shaking, even when rates of throughput become very high. In addition, this remains true if it is desired to vary speed during normal operation, providing bell-shaped profiles continue to be used.

It is then preferable for the profile associated with the second wheels to be taller than the profile associated with the first wheels in the central zone of said continuous speed-variation profiles. This makes it possible to have a first sheath segment transfer stage at a speed that increases slowly so as to bring the sheath segment accurately onto the insertion portion of the article concerned, and then to make up for lost time by ejecting the sheath segment very quickly, and then ending transfer very slowly so as to stop the sleeve engaged on the article very accurately in the desired final position for said sleeve.

It is also advantageous to provide for the common electronic programmer to have in memory a series of pairs of bell-shaped profiles which are preprogrammed. This makes it possible to have a large number of pairs of preprogrammed bell-shaped profiles as a function of operating conditions, in particular as a function of desired sleeve lengths or as a function of the types of heat-shrink plastics material used, and also a function of the speeds at which articles are conveyed.

In an advantageous embodiment, the apparatus for placing sleeves has a pair of first wheels driven by a common electric motor, and a pair of second wheels each driven by a respective electric motor one of which is slaved to the other.

Provision can also be made for the sleeve-placing apparatus further to include third wheels disposed immediately downstream from the cutting means, said third wheels being mechanically coupled to the first wheels to rotate at a slightly higher speed than the speed of said first wheels. These third wheels are advantageous for organizing assistance in separating the cut-off segment from the remainder of the sheath situated upstream from the cutting means. Provision is then made advantageously for the apparatus to include a third pair of wheels whose axes are offset from the axes of the second pair of wheels by a distance which corresponds substantially to the length of a cut-off sheath segment.

The control associated with the stepper conveyor means for the articles can use conventional designs based on direct mechanical drive from a central motor and gearbox unit, or more advantageously, use can be made of the principle whereby control is obtained from the rotary encoder that is provided in the apparatus of the invention. Under such circumstances, the above-mentioned common programmer will also include an electronic control card associated with the stepper conveyor means for the articles so as to control the conveyor means from the rotary encoder.

BRIEF DESCRIPTION OF THE DRAWINGS

Other characteristics and advantages of the invention appear more clearly in the light of the following description and the accompanying drawing, relating to a particular embodiment, and with reference to the figures in which.

DETAILED DESCRIPTION OF THE PREFERRED EMBODIMENTS

Figure 1:
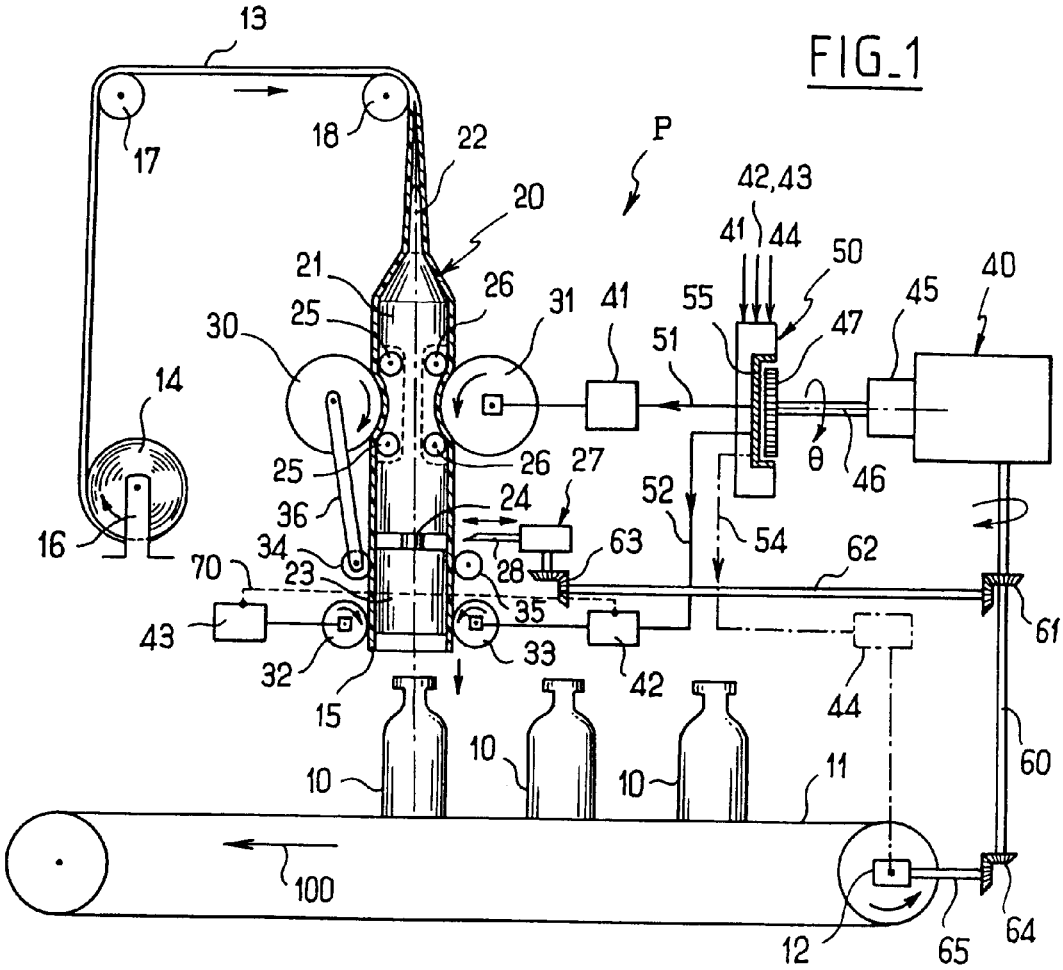
FIG. 1 shows apparatus of the invention for placing sleeves, with symbolic representation of the various rotary drive means for the wheels that co-operate with the sleeve passing over the shaper (which is vertical in this case) and with the cut-off segment of sheath.

FIG. 1 shows a sleeve-placing machine P of the invention for putting sleeves on conveyed articles.

Articles 10 represented as flasks in this case are being conveyed on a conveyor belt 11 in a direction referenced 100, said conveyor belt being driven stepwise from a unit 12.

A flat sheath of heat-shrink plastics material 13 is delivered from a reel 14 mounted to rotate on a portion of the structure 16, said sheath passing over rollers 17 and 18 so as to come over a shaper 20 for opening the sheath.

In conventional manner, the shaper 20 for opening the sheath, which shaper is vertical in this case, comprises a central portion 21 surmounted by a flat portion 22 so as to open progressively the continuous wheel 13 as it reaches said shaper. The sheath opening shaper 20 also has a downstream portion 23 connected to the upstream portion 21 by a ligament 24, and cutting means 27 having a moving blade 28 operating level with the ligament to cut the sheath on being given an appropriate control instruction. The shaper 20 is of the floating type, i.e., it is held in place by co-operation between first outside wheels 30, 31 and pairs of parallel-axis backing wheels 25, 26 carried by said shaper. The same would apply if the shaper were disposed horizontally or even obliquely, in a variant not shown herein.

The continuous sheath 13 which passes over the flattened portion 22 of the shaper 20 thus opens progressively over the portion 21 of said shaper, and passes between the wheel 30 and the backing wheels 25, and also between the wheel 31 and the backing wheels 26, respectively. Said wheels 30 and 31 thus serving both to provide floating support for the shaper and also, since they are motor driven, to advance the sheath continuously along said shaper.

Second outside wheels 32 and 33 are provided downstream from the cutting means 28 to eject the cut-off segment of sheath, referenced 15, onto an article 10 brought into register therewith, i.e. in this case vertically below the shaper, by the conveyor means 11, 12 for moving the articles stepwise.

FIG. 1 also shows a central motor 40 of the asynchronous type which is used in this case not only for driving the cutting means 27 but also for actuating the article conveyor means 11, 12.

The motor 40 is shown as having an outlet shaft 60 which, via suitable gearing 61, drives a shaft 62 which in turn acts via gearing 63 to drive the cutting means 27. The shaft 60 also carriers gearing 64 which drives a shaft 65 connected to the gearbox 12 for driving the conveyor means; naturally, the conveyor means shown herein is merely a presentation given by way of example, it being understood that equivalent means could be provided for mechanically driving the articles, for example a pair of worm screws deposed side by side with the articles to be conveyed progressively being disposed between them. It is also shown below that control of the stepper conveyor means 11, 12 could be organized differently without using the mechanical transmission described above.

The asynchronous motor 40 has a stepdown gearbox 45 comprising an outlet shaft 46 whose angular position is represented by the angle θ, and at the end of which there is an encoder 47. The encoder comprises an etched disk having a large number of points representative of the angular position θ of the shaft 46, e.g. 20,000 points. According to a characteristic of the invention, the rotary encoder 47 is used to organize synchronized control of the various measurement means used for rotating the wheels 30, 31 for advancing the sheath over the shaper, and the wheels 32, 33 for ejecting the cut-off segments of sheath 15 onto the conveyed articles 10.

An electric motor 41 for driving the pair of wheels 30 and 31 for advancing the sheath is shown diagrammatically as is a motor 42 for driving the pair of wheels 32, 33 for ejecting the cut-off segments. Specifically, the pair of first wheels 30, 31 is driven by a common electric motor 41, while the wheels of the pair of second wheels 32, 33 are driven by respective associated electric motors 42 and 43 one of which (in this case the motor 43) is slaved to the other (in this case the motor 42). The master-slave relationship is represented by the dashed line 70. This master-slave relationship, which is conventional in the field of electric motors, is such that the wheel 32 driven by the motor 43 always rotates at exactly the same speed as the wheel 33 driven by the motor 42.

The first wheels 30, 31 for advancing the wheel and the second wheels 32, 33 ejecting the cut-off segment 15 are then rotated by the respective associated electric motors 41, 42, 43 which are controlled synchronously by a common electronic programmer 50 which is arranged to determine a continuous profile for variation in the speeds of said motors so as to cause each sheath segment 15 to be transferred onto the corresponding article 10. It is possible to use a multi-track electronic programmer, including at least one electronic control card shown diagrammatically at 55, and in this case only one such card, known to persons skilled in the art as an "axis control card". This single electronic control card 55 has two control lines referenced 51 and 52 extending therefrom going respectively to the control inputs of the motor 41 for driving the wheels 30, 31 and the motor 42 for driving the wheels 32, 33. Thus, the electric motors 41 and 42 are controlled so as to operate perfectly synchronously and on the basis of the common rotary encoder 47 which gives a measure, with extremely high accuracy inherent to the number of points thereof, of the sole parameter representing the angle of rotation θ of the shaft 46 carrying said encoder. Since the rotary encoder 47 is mounted at the outlet of the central motor and gearbox unit 40 and 45, and since the motor 40 drives the article stepper conveyor means 11, 12 directly, in this case by mechanical means, it is certain that the travel of the articles is synchronized accurately with the organization of the way in which the wheels 30, 31 and 32, 33 are rotated. Conditions are then ideal for opening the way to extremely high operating rates of throughput, while using sleeves of diameter that is little greater than the maximum diameter of the articles in question.

In this case, third wheels are also provided which are disposed immediately downstream from the cutting means 27 and which are intended to provide assistance in separating the cut-off sheath segment from the portion of the continues sheath that remains upstream of the cutting means. Specifically, there can be seen a pair of third wheels 34, 35 disposed immediately downstream from the cutting means 27, said third wheels being mechanically coupled to the first wheels 30, 31, e.g. by means of a belt 36, so as to rotate at a speed that is slightly higher than the speed of said first wheels. In practice, this speed is about 1% higher than the speed of rotation of the wheels 30, 31, with this difference being automatically imposed by the mechanical transmission 36. Under such circumstances, it is advantageous to provide for the pair of third wheels 34, 35 to have axes which are offset from the pair of second wheels 32, 33 by a distance which corresponds substantially to the length of the segment of sheath 15 that is cut off so that the sheath segment 15, on leaving the cutting line, is in contact with both pairs of wheels 32, 33 and 34, 35.

Figure 2:
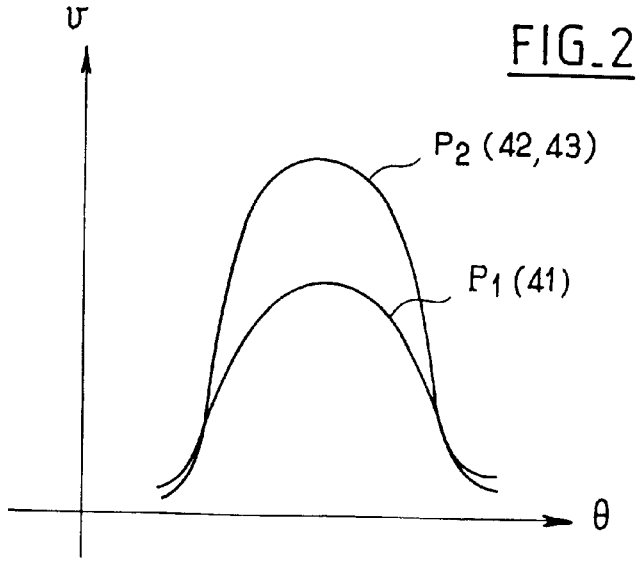
FIG. 2 is a diagram showing two bell-shaped profiles representing variations in the speeds of rotation of the sheath advance wheels and of the ejector wheels as a function of the angle of rotation of the shaft carrying the angular encoder.

As mentioned above, the common electronic programmer 50 is arranged to determine continuous profiles of speed variation firstly for the motor 41 and secondly for the motors 42 and 43, so as to cause each sheath segment 15 to be transferred onto the corresponding article 10. These continuous profiles are shown in FIG. 2 which is a plot of variations in speed referenced $\underline{v}$ as a function of the angle θ of rotation of the shaft 46. There can thus be seen a first profile P1 corresponding to the motor 41 and a second profile P2 corresponding to the motors 42 and 43. As can be seen in FIG. 2, the profiles P1 and P2 are both bell-shaped, corresponding in this case substantially to a portion of a sinewave. It is important to observe that in the central zones of the continuous profiles of speed variation P1 and P2, the profile P2 associated with the second wheels 32, 33 is taller than the profile P1 associated with the first wheels 30, 31. This bell-shaped profile makes it possible to ensure that acceleration and deceleration take place entirely progressively, without any sharp-angled points being present in the profile as is the case for the squarewave profiles of prior art machines. This continuous profile that is also continuously variable, guarantees absence of shaking, and this continues to apply regardless of the rate of throughput required from the apparatus. This absence of shaking makes it possible, where desired, to use sleeves that have one or more lines of microperforations for the purpose of facilitating subsequent opening of the sleeves, even when such lines are very weak. The representation given herein for the profile P2 with its central portion taller than that of the profile P1 shows clearly that the cut-off sheath segment 15 is transferred with a first stage of descent that is slow and corresponds to the sheath segment beginning to be separated from the continuous sheath, followed by the sheath segment moving down quickly onto the article, so as to catch up for the lateness acquired during the slow first stage of descent, and finally the last stage of descent of the sheath segment is slow so that the final position of the segment on the article is controlled with great accuracy.

Such pairs of profiles P1, P2 which correspond in fact to simulating cam profiles, thus make it easy to deliver accurately synchronized control for the electric motors that rotate the wheels 30, 31 or that rotate the wheels 32, 33. For the first time, the ejector wheels 32, 33 are rotated under conditions which, while being synchronized with those of the wheels 30, 31 for advancing the sheath, are fully under control so as to obtain downward movement of the cut-off sheath segment 15 that is under control from the beginning to the end. Naturally, as is conventional in electronic axis control systems, advantage is taken of information returned from the motors 41, 42, 43 to the programmer 50 (if the electric motors have integrated encoders, then this information will come from such encoders), and this is represented by arrows shown at the top of said programmer. The electronic control card 55 delivers at all times, for each angle θ corresponding to the angle of rotation of the shaft 46 carrying the encoder 47, control pulses to the motors 41 and 42 and corresponding to obtaining the required cam profiles P1 and P2 accurately. Servo-controlling the motors 41 and 42 thus makes it possible to adapt the control of these motors on each occasion so that drive thereof remains accurately synchronous with the desired bell-shaped profiles.

It can be advantageous to provide for the common electronic programmer to possess a series of pairs of bell-shaped profiles P1, P2 in memory, which memory is preprogrammed. The central programmer then controls the motors so that the real conditions match those of the bell-shaped profiles. This makes it possible to obtain versatile operation of the cutting device P suitable for taking account of different working lengths of sleeve, and also other conditions such as the thickness and/or the material constituting the heat-shrink plastics material sheath, and indeed the speeds at which the articles are fed.

As will have been understood, it is now possible to cause speed to be varied while the apparatus is in normal operation, and do so at any time, merely by acting on the control of the central motor and gearbox unit 40, 45. Any change to the speed of rotation of the shaft 46 will give rise to corresponding changes to the angular position of the encoder 47 and consequently to the commands in the form of pulses issued over the lines 51, 52 to the motors 41 and 42. Because of the synchronization also provided for driving the stepper conveyor 11, 12, this change of speed during normal operation is automatically applied to the travel speed of the articles 10.

To improve this general synchronization, it is possible to provide for the common electronic programmer 50 further to include a control card associated with the article stepper conveyor means in order to control it from the rotary encoder 47. Specifically, a card 55 is shown for controlling three axes, with a third control line 54 represented by a chain-dotted line leaving this electronic control card and being applied to an electric motor 44 for driving the stepper conveyor means 11, 12 (it should be observed that information can likewise be returned from the electric motor 44 to the programmer 50, in addition to the information returned from the motors 41, 42, and 43). Depending on circumstances, if only one electronic control card is available having two axis control outlets, then it will suffice to provide an additional card serving solely for controlling the electric motor 44 associated with driving the stepper conveyor means 11, 12. That is no more than a variant within the competence of the person skilled in the art familiar with using electronic programmers for axis drive control. These modifications to apparatus for putting sleeves into place are naturally most advantageous insofar as overall synchronization is obtained in a way that is very flexible for all of the electric drive motors, with absolute synchronization being obtained between advance of the sheath, injection of the cut-off sheath segment, and travel of the articles past the shaper. Under such circumstances, the single mechanical drive from the central motor 40 is restricted to driving the cutting means 27. As a result this makes it possible for the motor 40 to be an asynchronous motor that is much smaller than when it has to provide mechanical power directly to the stepper conveyor means.

Synchronizing control of the motors and of the transfer of cut-off sheath segments thus makes it possible to position the sleeves on the articles with very high accuracy, even at very high rates of throughput and with sleeves of diameter that is hardly any greater than the maximum diameter of the articles (e.g. 0.5 mm to 1 mm greater), thus making it possible to obtain excellent control over the quality of shrinkage. Tests performed by the Applicant have thus made it possible to show that under such conditions, accuracy is obtained of the order of two-tenths of a millimeter, and that with long sleeves (e.g. about 250 mm long), it is easy to reach throughputs of 250 cuts per minute.

This absolute synchronization thus makes it possible to envisage sheaths of sizes that are very close to the sectional sizes of the articles concerned. It is possible to use sleeves whose inside section is very close to the section of the articles without running the risk of the sleeves being badly positioned, because the sleeves are transferred under control whereas in prior art machines it was necessary to leave a safety margin, using sheath segments of section considerable larger than the section of the articles. This is of particular importance when using the apparatus to put heat-shrink sleeves into place: if the sectional dimensions of sheath segments are close to the section dimensions of the articles they are to cover, then the amount of shrinkage required is small, and very high control is retained enabling shrinkage to be achieved perfectly. In contrast, in conventional sleeve-placing machines, the safety margin requires sheath segments to be much larger than the articles they cover, and in practice that makes it impossible to control the quality of the shrinking.

Thus, the apparatus described above makes it possible simultaneously to obtain optimum control of sleeve positioning on an article because the transfer of said sleeve is under control from end to end, which was not the case with the ejector wheels of prior art sleeve-placing machines which did no more than eject cut-off segments at an instant given by a sensor cell. This transfer of cut-off segments also tracks the travel of the articles, preserving synchronization between the sleeve and the article at all design operating speeds, and naturally including high speeds.

The invention is not limited to the embodiment described above, but on the contrary covers any variant using equivalent means to reproduce the essential characteristics specified above.

What is claimed is:

1. Apparatus for placing sleeves onto conveyed articles, said sleeves being cut from a continuous sheath (13) passing over a sheath opening shaper (20) which is held floating by co-operation between first outside wheels (30, 31) and parallel-axis backing wheels (25, 26) carried by said shaper, said first wheels causing the sheath to advance along the shaper (20) up to cutting means (27), second outside wheels (32, 33) being provided downstream from the cutting means (27) to eject the cut-off sheath segment (15) onto the article (10) fed into register with the shaper by stepper conveyor means (11, 12) of the articles, wherein the first wheels (30, 31) and the second wheels (32, 33) are rotated by associated electric motors (41; 42, 43) controlled synchronously by a common electronic programmer (50) arranged to determine a continuous profile (P1, P2) for speed variation of said motors so as to control the transfer of each sheath segment (15) onto the corresponding article (10), said programmer including at least one electronic control card (55) which cooperates with an adjacent encoder (47) mounted at the end of a shaft (46) rotated by a central motor and gearbox unit (40, 45).

2. Sleeve-placing apparatus according to claim 1, wherein the continuous profiles (P1, P2) for speed variation of the electric drive motors (41; 42, 43) of the first and second wheels (30, 31; 32, 33) are bell-shaped.

3. Sleeve-placing apparatus according to claim 2, wherein the central portions of the continuous speed variation profiles (P1, P2) are such that the profile (P2) associated with the second wheels (32, 33) is taller than the profile (P1) associated with the first wheels (30, 31).

4. Sleeve-placing apparatus according to claim 2, wherein the common electronic programmer (50) has in memory a series of pairs of bell-shaped profiles (P1, P2) which are programmed.

5. Sleeve-placing apparatus according to claim 1, having a pair of first wheels (30, 31) driven by a common electric motor (41), and a pair of second wheels (32, 33) each driven by a respective electric motor (42, 43) one of which (43) is slaved to the other (42).

6. Sleeve-placing apparatus according to claim 5 further including third wheels (34, 35) disposed immediately downstream from the cutting means (27), said third wheels being mechanically coupled to the first wheels (30,31) to rotate at a slightly higher speed than the speed of said first wheels, the axes of said third pair of wheels being offset from the axes of the second pair of wheels (32, 33) by a distance which corresponds substantially to the length of a cut-off sheath segment (15).

7. Sleeve-placing apparatus according to claim 1, further including third wheels (34, 35) disposed immediately downstream from the cutting means (27), said third wheels being mechanically coupled to the first wheels (30, 31) to rotate at a slightly higher speed than the speed of said first wheels.

8. Sleeve-placing apparatus according to claim 1, wherein the common programmer (50) also includes an electronic control card (55) associated with the stepper conveyor means (11, 12) for conveying the articles, in order to control said means from the rotary encoder (47).

* * * * *